US008324831B2

(12) United States Patent
Lai

(10) Patent No.: US 8,324,831 B2
(45) Date of Patent: Dec. 4, 2012

(54) LIGHT EMITTING DIODE ILLUMINATING SYSTEM AND CONTROLLING METHOD THEREOF

(75) Inventor: Chih-Chen Lai, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 322 days.

(21) Appl. No.: 12/756,977

(22) Filed: Apr. 8, 2010

(65) Prior Publication Data

US 2010/0320939 A1 Dec. 23, 2010

(30) Foreign Application Priority Data

Jun. 19, 2009 (CN) ..... 2009 1 0303442

(51) Int. Cl.
*H05B 37/02* (2006.01)
*G05F 1/00* (2006.01)

(52) U.S. Cl. ..... 315/291; 315/307

(58) Field of Classification Search ..... 315/291, 315/307, 112, 118, 200 R, 224, 246, 247
See application file for complete search history.

(56) References Cited

U.S. PATENT DOCUMENTS 6,670,780 B2 * 12/2003 Ono et al. ..... 315/291
6,975,077 B2 * 12/2005 Izumi et al. ..... 315/209 R
7,295,180 B2 * 11/2007 Ichikawa et al. ..... 345/102

* cited by examiner

*Primary Examiner* — Douglas W Owens
*Assistant Examiner* — Minh D A
(74) *Attorney, Agent, or Firm* — Altis Law Group, Inc.

(57) ABSTRACT

A light emitting diode (LED) illuminating system includes an LED lamp, a sensor, a memory, a controller, an AC/DC convertor, a DC/DC convertor and a current detector. The sensor detects a temperature around the LED illuminating system. The memory stores the detected temperature and a comparison table. The controller finds an optimized working voltage in the comparison table, according to the detected temperature. The AC/DC converter outputs a DC power with the optimized working voltage. The DC/DC converter converts the DC power into another DC power and supplies the another DC power to the LED lamp. The current detector detects a current variation of the another DC power. The controller stabilizes a current of the another DC power output by the DC/DC converter to the LED lamp, according to the current variation.

5 Claims, 2 Drawing Sheets

LIGHT EMITTING DIODE ILLUMINATING SYSTEM AND CONTROLLING METHOD THEREOF

BACKGROUND

1. Technical Field

The present disclosure generally relates to illuminating systems and controlling method thereof, and particularly, to a light emitting diode (LED) illuminating system and a controlling method thereof.

2. Description of Related Art

Nowadays, most of the LED illuminating systems are supplied with an alternating current. Generally, the alternating current, which is supplied to the LED illuminating system, is firstly converted into a low-voltage direct current by an AC/DC (alternating current to direct current) converter and successively converted into a constant direct current by a DC/DC (direct current to direct current) converter. Finally the constant direct current is supplied to the LED illuminating system. However, the AC/DC converter usually has a predetermined and invariable output voltage which cannot vary according to different working temperatures around the LED illuminating system. The DC/DC converter requires different voltages due to different temperatures so that the DC/DC converter can output the constant direct current to the LED lamp. As such, when the working temperature changes, the predetermined voltage supplied from the AC/DC converter to the DC/DC converter should be more or less than the predetermined voltage that the AC/DC converter will supply to the DC/DC converter in the normal rated temperature; otherwise, an unsatisfied illuminating efficiency of the illuminating system occurs since the direct current supplied to the LED lamp by the DC/DC converter can no longer be constant.

Therefore, what is needed is an illuminating system and a controlling method of the illuminating system that overcome the described limitations.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views, and all the views are schematic.

DETAILED DESCRIPTION

Reference will now be made to the drawings to describe various embodiments of the present LED illuminating system and controlling method thereof, in detail.

Figure 1:
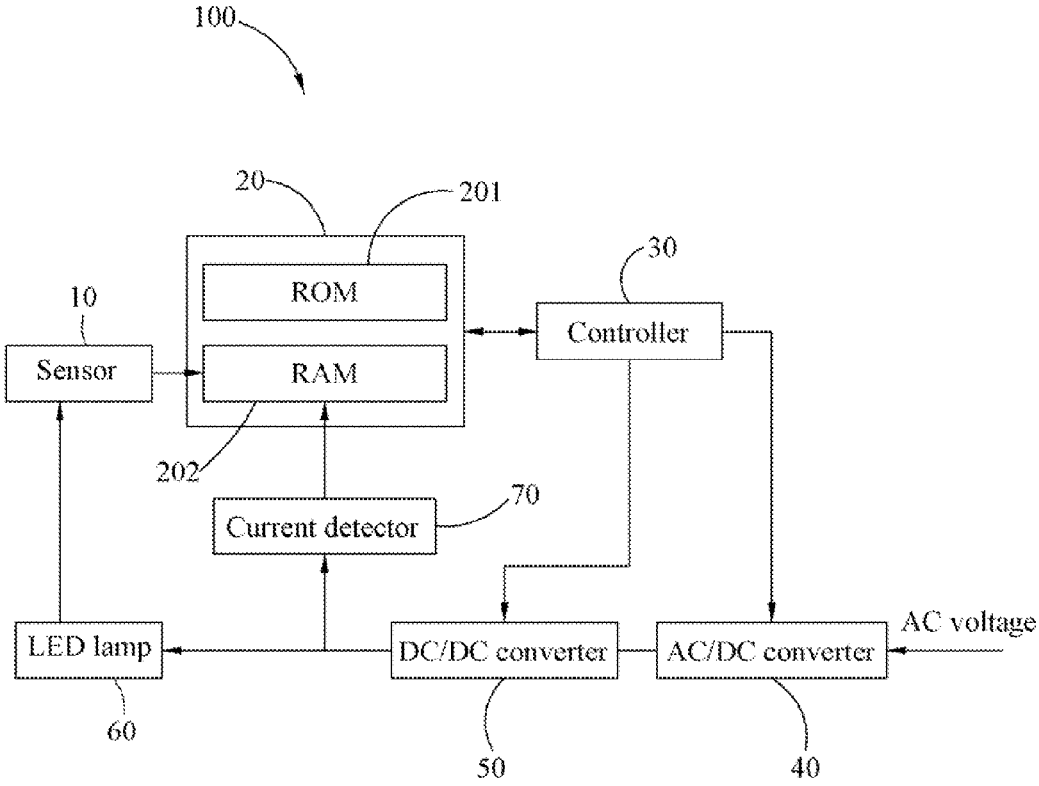
FIG. 1 is a block diagram of an LED illuminating system, according to an embodiment of the present disclosure.

Referring to FIG. 1, an LED illuminating system 100, according to an embodiment, includes a sensor 10, a memory 20, a controller 30, an AC/DC converter 40, an DC/DC converter 50, an LED lamp 60 and a current detector 70.

The sensor 10 is arranged in the vicinity of the LED lamp 60. The sensor 10 is configured for detecting a working temperature around the LED illuminating system 100, and sending the detected temperature to the memory 20.

The memory 20 is configured for receiving the detected temperature and storing the detected temperature therein. An illuminating efficiency of the LED lamp 60 is influenced by a current of a DC power supplied thereto from the DC/DC converter 50 which in turn is influenced by a voltage of a DC power supplied thereto by the AC/DC converter 40. The voltage of the DC power of the AC/DC converter 40 supplied to the DC/DC converter 50 is adjustable according to a change of the working temperature around the LED illuminating system 100; thus, an optimized working voltage of the LED illuminating system 100 according to a change of the working temperature around the LED illuminating system 100 is obtainable. In this embodiment, a predetermined comparison table of optimized working voltages of the LED illuminating system 100 under different working temperatures is made and stored in the memory 20. The memory 20 includes a read only memory (ROM) 201 and a random access memory (RAM) 202. The ROM 201 is for storing the table of the different temperatures and optimized working voltages. The RAM 202 is for storing the detected working temperature.

The controller 30 is configured for accessing the detected working temperature stored in the RAM 202, searching the table stored in the ROM 201 to find an optimized working voltage of the LED illuminating system 100 corresponding to the detected working temperature and sending the optimized working voltage to the AC/DC converter 40.

The AC/DC converter 40 is configured for converting an AC (alternating current) power into a DC (direct current) power, adjusting the voltage of the DC power to have a value equal to the optimized working voltage and outputting the DC power with the optimized voltage to the DC/DC converter 50.

The DC/DC converter 50 is configured for receiving the DC power with the optimized voltage, converting the DC power with the optimized voltage into another DC power, and outputting the another DC power to the LED lamp 60.

The LED lamp 60 receives the another DC power output by the DC/DC converter 50 and emits light.

The current detector 70 is configured for detecting a current variation of the another DC power output by the DC/DC converter 50, and sending the detected current variation to the RAM 202. The controller 30 controls the DC/DC converter 50 to output a constant current, which satisfies the LED lamp 60 to work with a normal and constant illuminating efficiency, based on the detected current variation.

Figure 2:
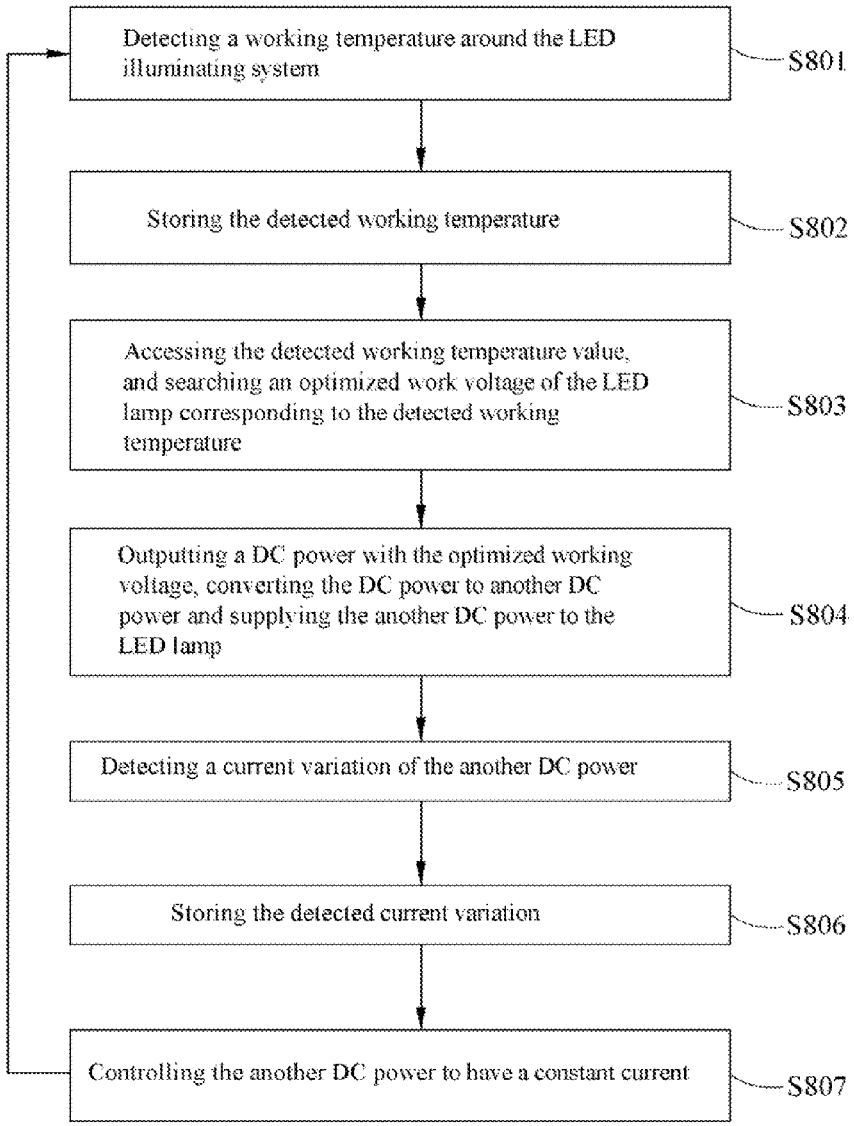
FIG. 2 is a flow chart of a method for controlling the LED illuminating system of the FIG. 1.

Referring to FIG. 2, a flow chart of a method for controlling the LED illuminating system 100 is also illustrated. The method includes steps as following:

- S801: Detecting a working temperature around the LED illuminating system 100;
- S802: Storing the detected working temperature;
- S803: Accessing the detected working temperature and searching for an optimized working voltage of the AC/DC converter 40 of the LED illuminating system 100 corresponding to the detected working temperature;
- S804: Outputting a DC power with the optimized working voltage, converting the DC power with the optimized working voltage into another DC power, and supplying the another DC power to the LED lamp 60;
- S805: Detecting a current variation of the another DC power supplied to the LED lamp 60;
- S806: Storing the detected current variation;
- S807: Controlling the another DC power to have a constant current based on the detected current variation.

Referring to step S801, the detection is performed by the sensor 10. The sensor 10 can be configured for monitoring the working temperature around the LED illuminating system 100 in real time. The sensor 10 can also be configured for performing the detection in intervals.

Referring to step S802, the detected working temperature is stored in the memory 20.

Referring to step S803, the detected working temperature stored in the memory 20 is accessed by the controller 30; the controller 30 compares the table of the different temperatures and optimized working voltages and the detected working temperature to find an optimized working voltage for the LED illuminating system 100.

Referring to step S804, the AC/DC converter 40 is utilized to output the DC power with the optimized working voltage. The DC/DC converter 50 is utilized to convert the DC power with the optimized working voltage into the another DC power and supply the another DC power to the LED lamp 60.

Referring to steps S805 and S806, the current detector 70 is utilized to detect the current variation of the another DC power supplied to the LED lamp 60, and the RAM 202 is utilized to store the detected current variation.

Referring to step S807, the controller 30 is further utilized to adjust the current of the another DC power output by the DC/DC converter 40 in order to stabilize the current of the another DC power to have a constant value, based on the detected current variation.

It is to be understood that the above-described embodiments are intended to illustrate rather than limit the disclosure. Variations may be made to the embodiments without departing from the spirit of the invention as claimed. The above-described embodiments illustrate the scope of the disclosure but do not restrict the scope of the disclosure.

What is claimed is:

1. A light emitting diode (LED) illuminating system, comprising:

an LED lamp;

a sensor for detecting a temperature around the LED illuminating system;

a memory for receiving the detected temperature, and storing the detected temperature and a predetermined comparison table of different temperatures and optimized working voltages therein;

a controller for accessing the detected temperature stored in the memory, searching the table of different temperatures and optimized voltages to find an optimized working voltage of the LED illuminating system corresponding to the detected temperature;

an AC/DC convertor for converting an AC power into a DC power, and adjusting a voltage of the DC power to have a value equal to the optimized working voltage;

a DC/DC convertor for receiving the DC power with the optimized DC voltage, converting the DC power with the optimized DC voltage into another DC power, and outputting the another DC power to the LED lamp; and a current detector for detecting a current variation of the another DC power output by the DC/DC converter, wherein the detected current variation is stored in the memory, and the controller adjusts a current of the another DC power output by the DC/DC converter to compensate the current variation, thereby stabilizing the current of the another DC power output by the DC/DC converter to the LED lamp.

2. The LED illuminating system according to claim 1, wherein the memory comprises a read only memory and a random access memory, the read only memory is for storing the predetermined comparison table of temperatures and voltages, and the random access memory is for storing the detected temperature.

3. The LED illuminating system according to claim 1, wherein the sensor performs the detecting action in real time.

4. The LED illuminating system according to claim 1, wherein the sensor performs the detecting action in intervals.

5. A method for controlling an LED illuminating system, comprising:

detecting a working temperature around the LED illuminating system;

storing the detected working temperature;

accessing the detected working temperature, and searching an optimized working voltage of the LED illuminating system corresponding to the detected working temperature;

outputting a DC power with the optimized working voltage, converting the DC power with the optimized working voltage into another DC power, and supplying the another DC power to the LED lamp;

detecting a current variation of the another DC power supplied to the LED lamp;

storing the detected current variation; and controlling a current of the another DC power to have a constant value based on the detected current variation.

* * * * *